United States Patent [19]

Bengtsson

[11] Patent Number: 4,518,178

[45] Date of Patent: May 21, 1985

[54] LOCKING DEVICE

[75] Inventor: Sigurd W. Bengtsson, Gothenburg, Sweden

[73] Assignee: AB Fixfabriken, Gothenburg, Sweden

[21] Appl. No.: 489,776

[22] Filed: Apr. 29, 1983

[30] Foreign Application Priority Data

Apr. 29, 1982 [SE] Sweden ..... 8202702

[51] Int. Cl.[3] ..... E05C 9/04; E05B 9/08

[52] U.S. Cl. ..... 292/8; 292/1; 292/337; 70/370

[58] Field of Search ..... 292/337, 1, 336.3, 8, 292/5, 26, 30; 70/109, 370

[56] References Cited

FOREIGN PATENT DOCUMENTS 732992 3/1943 Fed. Rep. of Germany ..... 292/8

510011 1/1955 Italy ..... 292/8

*Primary Examiner*—Richard E. Moore

*Attorney, Agent, or Firm*—Hill, Van Santen, Steadman & Simpson

[57] ABSTRACT

A device for keeping a door, a window, a shutter, etc., in a closed position. The device comprises operating elements housed in a casing attachable to a bar. The operating elements are connected to an element maneuvering at least one bolt.

A lock part of the device is formed as an insert of a predetermined dimension having a lock of an optional lock type therein and arranged for being inserted directly into the housing within a space of a corresponding dimension.

7 Claims, 7 Drawing Figures

LOCKING DEVICE

BACKGROUND OF THE INVENTION

1. Field of the Invention

The present invention relates to a lockable device operable by a handle for keeping a door, a window, a shutter, etc., preferably an entrance door, in a closed position.

2. Prior Art

The problem behind the invention is to construct the device such that it allows simple application of various lock types therein, dependent on lock security, ease of operation and regulating, etc. An easy replacement is of interest for instance in connection with devices of the espagnolette type.

As far as known, presently in such applications there is no arrangement allowing an easy replacement of the lock for shifting between for instance a pin lock, a disc lock, a lever tumbler lock, etc.

SUMMARY OF THE INVENTION

The present invention is a device for obviating said lack. In the broadest sense thereof, there is provided a device operable by a handle, for instance a door handle, for keeping a door, a window, a shutter, etc., preferably an entrance door, in a closed position, comprising operating elements housed within a casing attached to a bar, for instance an espagnolette bar, and operatively connected to an element, for instance an espagnolette rod, for maneuvering at least one bolt, and means for latching and locking said bolt. The device is characterized in that at least the lock part of said latching and locking means is formed as an insert of a predetermined dimension and having a lock of an optional type therein, said insert being insertable directly into the casing within a space of a corresponding dimension, preferably a cut out at the corner of the casing.

In applications where the maneuvering elements also comprise means for maneuvering of a further bolt in addition to a bolt the first type, preferably the first mentioned bolt as well as the further bolt are latchable by means of a latch acting on said elements.

When the arrangement is such that the bar thereof is an espagnolette bar and said maneuvering element comprises an espagnolette rod, for instance an undivided rod, preferably the insert comprises a control member rotatable by a key for positioning the latch in engagement with and disengagement from, respectively, the espagnolette rod.

In a preferred embodiment there is a recess in the espagnolette rod for allowing said engagement and disengagement, respectively.

In order to accomplish latching of the further bolt, preferably there is an abutment, for instance a stud, on the espagnolette rod latching the further bolt in the engagement position of the latch.

In a further preferred embodiment, the bolt(-s) of the first mentioned type is (are) of hook type and the further bolt is of the bevelled type.

An insert, preferable from a manufacturing and mounting point of view, has the shape of a casette attachable, for instance by screws, in a cut-out at the corner region of the casing.

ON THE DRAWINGS

FIG. 1 shows the basic construction of the arrangement according to the invention;

FIG. 2 in a partial view shows the arrangement with a lock type different from the one in FIG. 1;

AS SHOWN ON THE DRAWINGS

Figure 1:
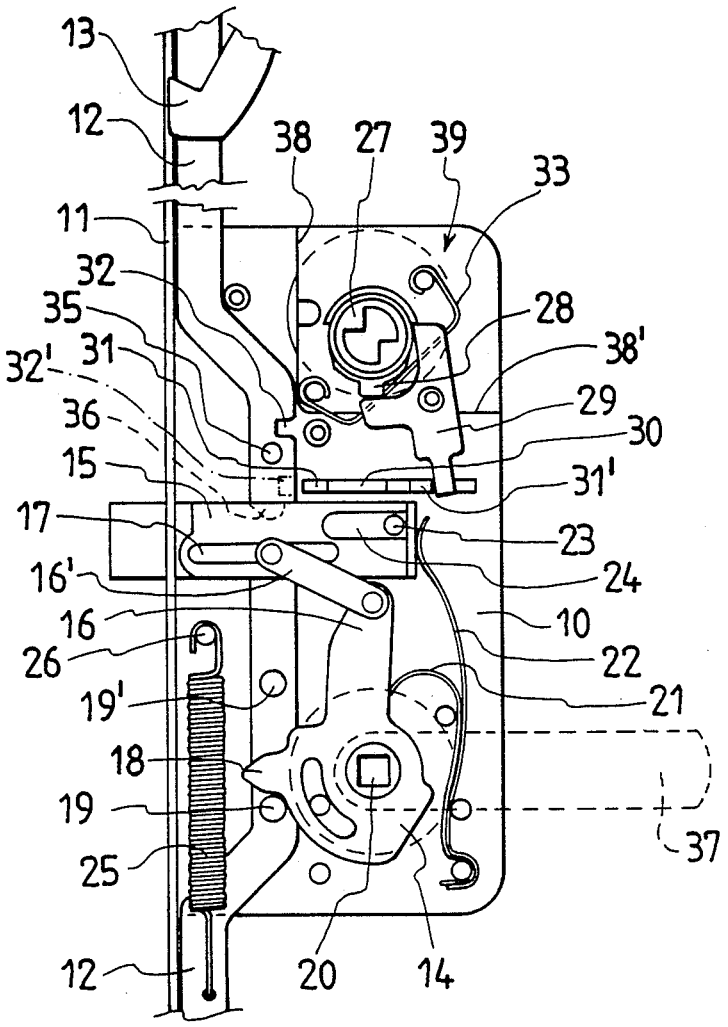

FIG. 1 shows an espagnolette having a lock casing 10 attached to an espagnolette edge bar 11. The bar as well as the casing are to be mounted in a recess in a door casement. There is an espagnolette rod 12 displaceable along the door edge and acting as a latching rod for maneuvering two bolts 13 (only one shown). Within the casing 10 there is an operating member 14 acting on a bevelled bolt 15 via an arm 16 and link 16' co-operating with a groove 17 in the bolt 15, and acting on the latch rod 12 by an arm 18 co-operating with a pair of studs 19, 19'. There is a noncircular hole 20 in the operating member arranged for cooperation with a handle 37 or similar device (shown by broken lines in FIG. 1). A spring 21 has been mounted for returning the handle 37 to horizontal position after the handle has been pushed down when opening or closing the door. A spring 22 acts to hold the bevelled bolt 15 in position and for returning it to the extended position after it has been retracted. The movement of the bevelled bolt 15 and therefore also the movement of the operating member 14 is limited in both directions by a stud 23 attached to the lock casing and co-operating with an elongated groove 24 in the bevelled bolt. A tension spring 25, one end of which is fixed to a stud 26 in the casing and the other end of which is attached to the moveable espagnolette rod 12, maintains the latching rod 12 in such a position that the espagnolette bolt is retracted or pulled into the bar 11 when the handle is in the rest position thereof unless latching has taken place or the bolts 13 in any other way, for instance due to friction of the striking plate, are prevented from returning. Thus, in the rest position of the espagnolette according to FIG. 1 the espagnolette bolts 13 are pulled in or retracted and the bevelled bolt 15 is extended.

In order to make the espagnolette lockable by a cylinder lock, for instance as in FIG. 1, a casette 39 is inserted in the upper part of the lock casing 10. The casette has an operating member 27 having a dog 28 acting on a latch 30 via a three-armed lever 29. The latch has two pairs of lugs 31, 31' guided in grooves in both halves of the casing for guiding the movement of the latch. The latch 30 is arranged for co-operation with at least one recess 32 in the latch rod 12. A spring 33 in co-operation with the dog 28 is arranged for defining the end positions of the operating member 27.

The extent of the lock part 39 of the arrangement is limited by surfaces 38, 38' in FIG. 1 and the lock part is formed as a casette attachable to the casing, for instance by screws, and arranged for containing any system of different lock systems, for instance a pin lock, a disc lock, a lever tumbler lock, etc.

As far as the general function of the arrangement in FIG. 1 is concerned reference is made to the co-pending U.S. application Ser. No. 489,775, filed 4/29/83, and having the same priority date and assignee. However, as to the latching function obtained by the espagnolette bolts 13, preferably of so called hook type, and the bevelled bolt 15, it may be mentioned that in addition to the latching action obtained by the latch 30 by engagement with the recess 32 in the latching rod 12, said latching rod also accomplishes latching of the bevelled bolt 15 by a stud 35 on the latching rod in engagement with a latching recess 36 in the bevelled bolt 15.

Thus, the latching rod 12 is arranged for latching of both types of bolts 13 and 15. The locking is obtained by the lock part 39.

Figure 6:
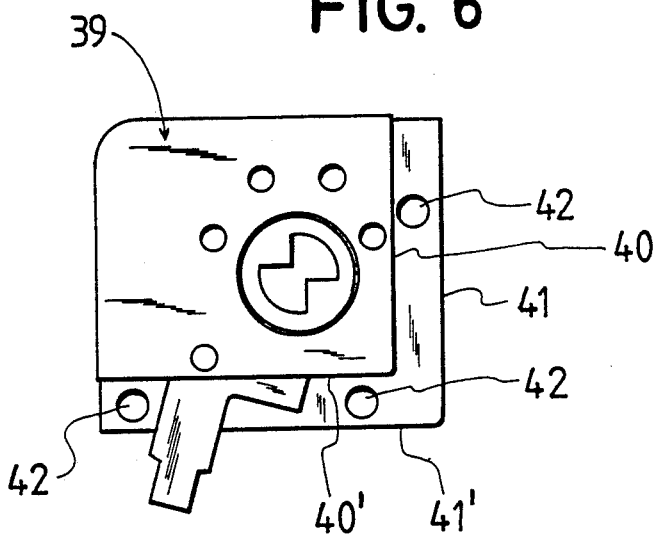
FIG. 6 shows a lock casette for insertion into a cut-out in a lock casing.

In FIG. 6 there is shown a casette 39 having wrapped over side edges 40, 40' and 41, 41' with holes 42 in the extended side portion defined by the edges 41, 41'.

Figure 7:
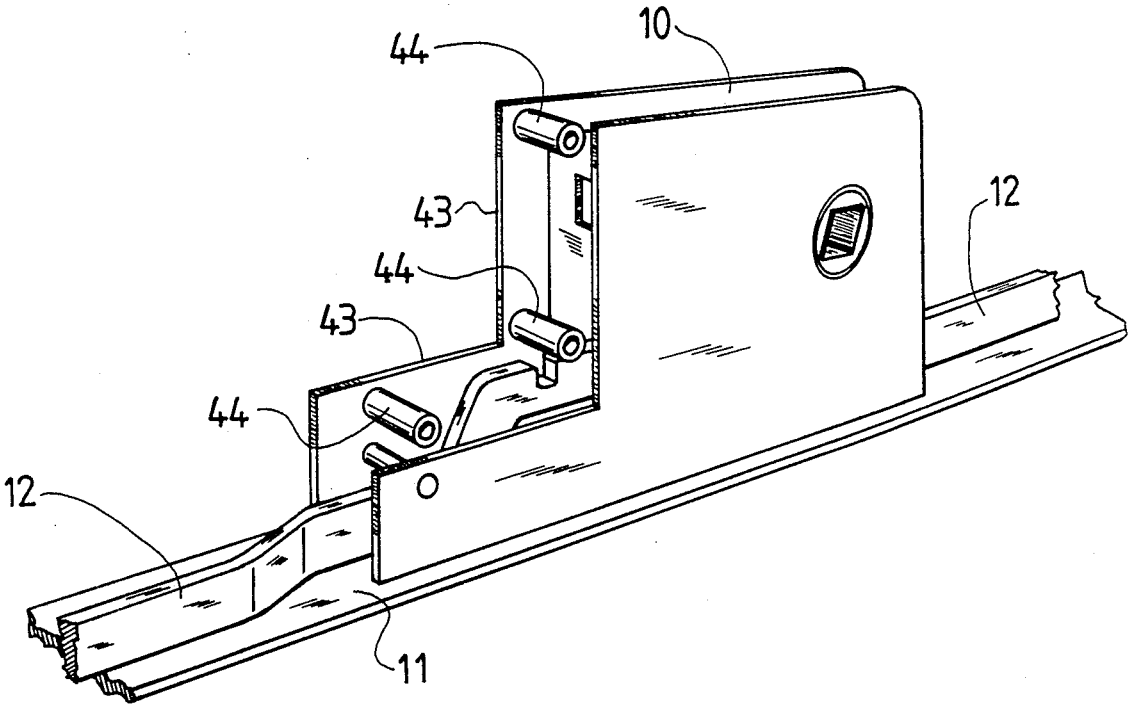
FIG. 7 in a perspective view shows a cut-out in a lock casing for accomodating a casette as in FIG. 6.

There is a corresponding wrapped over portion in the lock casing in FIG. 7. The lower extended portion of the housing 10 defined by edges 43 carries a number of studs 44 having holes therein in register with the holes 42 when the casette is pushed into the lock casing 10. The casette may be fixed very simply by screws in to the studs 44.

Figure 2:
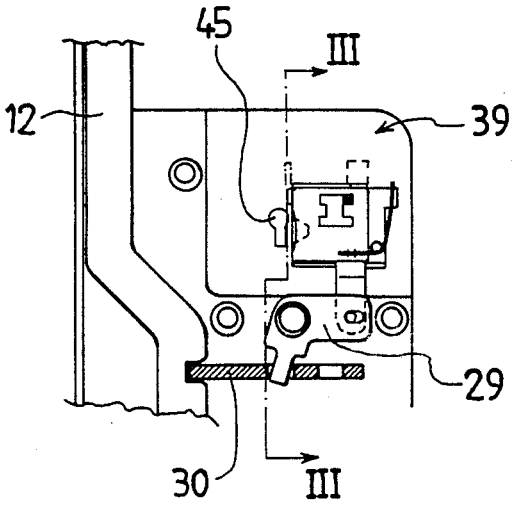
Figure 3:
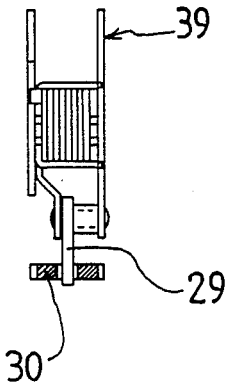
FIG. 3 is a cross-sectional view taken along line III—III in FIG. 2.

In order to illustrate also the usefulness of the inventive idea with other lock types, there has been shown in FIGS. 2 and 3 a first type of a lever tumbler lock, a nine lever tumbler lock. The bell crank 29 forming a part of the lock unit 39 is somewhat modified due to the construction of the lever tumbler lock. The lock in FIG. 2 may be locked in the conventional manner by inserting a key into a key hole 45.

Figure 4:
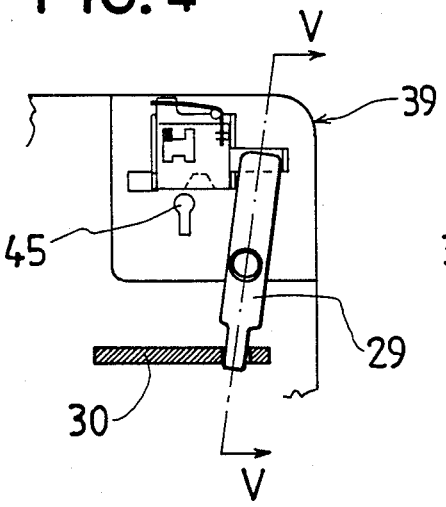
FIG. 4 shows an embodiment of a lock type different from the one in FIG. 2.
Figure 5:
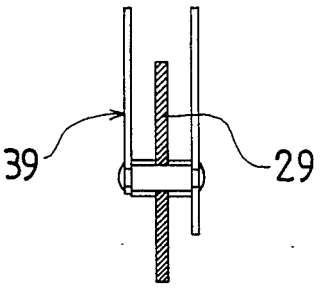
FIG. 5 is a cross-sectional view taken along line V—V in FIG. 4.

As the placement of the locking elements may vary between different lock types, which is illustrated in FIGS. 2 and 4, the maneuvering lever 29 extending from the casette may have various forms. In certain cases it may be necessary to replace the latching member 30.

I claim:

1. A building-closure operator for being installed on the edge of the closure for holding the closure in a closed position, comprising:

(a) an espagnolette edge bar adapted to be secured to the closure's edge;

(b) a casing secured to said edge bar and receivable in a recess in the closure, said casing having an open space of predetermined dimension;

(c) at least one bolt disposed remotely from said casing, and supported for movement through said edge bar to a locking position, and to a retracted position:

(d) an espagnolette rod operatively connected to said bolt for maneuvering it;

(e) handle-controlled operating means in said casing for reciprocating said rod; and (f) means for latching and locking said bolt, at least the lock part thereof being an insert of said predetermined dimension and directly insertable and disposed in said space and secured to said casing.

2. An operator according to claim 1, including a further bolt in said casing and also controlled by said operating means, and said latching means including a latch engageable with said rod for latching both said one bolt and said further bolt.

3. An operator according to claim 1, said lock part being key-operated, and an operating member in said insert and rotatable by the key for positioning the latch of said latching means into and out of latching engagement with said rod.

4. An operator according to claim 3, said rod having a recess receptive of said latch.

5. An operator according to claim 1, including a further bolt in said casing and also controlled by said operating means, and a stud on said rod latching said further bolt in response to the latch of said latching means being in its engagement position.

6. An operator according to claim 2, said one bolt being a pivotable hook, and said further bolt being slidable and having a bevelled end.

7. An operator according to claim 1, said insert being in the form of a cassette detachably secured to said casing, said open space being in the form of a cut-out at a corner of said casing.

* * * * *